US010941020B2

(12) United States Patent
St. Pierre et al.

(10) Patent No.: US 10,941,020 B2
(45) Date of Patent: Mar. 9, 2021

(54) DEFLECTOR SHEAVE BRACKET FOR OFFSET BEDPLATE

(71) Applicant: Otis Elevator Company, Farmington, CT (US)

(72) Inventors: Bruce St. Pierre, Unionville, CT (US); Bruce P. Swaybill, Farmington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 531 days.

(21) Appl. No.: 15/884,042

(22) Filed: Jan. 30, 2018

(65) Prior Publication Data

US 2019/0233253 A1 Aug. 1, 2019

(51) Int. Cl.

| | |
|---|---|
| ***B66B 15/02*** | (2006.01) |
| ***B66B 11/00*** | (2006.01) |
| ***B66B 7/08*** | (2006.01) |

(52) U.S. Cl.

CPC ..... *B66B 15/02* (2013.01); *B66B 11/00* (2013.01); *B66B 11/004* (2013.01); *B66B 11/008* (2013.01); *B66B 11/0045* (2013.01); *B66B 7/08* (2013.01)

(58) Field of Classification Search

CPC ..... B66B 11/008; B66B 11/004; B66B 15/02; B66B 7/08; B66B 7/10

See application file for complete search history.

(56) References Cited

U.S. PATENT DOCUMENTS

| | | | | |
|---|---|---|---|---|
| 7,261,187 | B2 * | 8/2007 | Fischer | B66B 11/00 187/412 |
| 7,478,705 | B2 | 1/2009 | Schaffhauser et al. | |
| 8,602,174 | B2 | 12/2013 | Aulanko et al. | |
| 9,010,497 | B2 | 4/2015 | Saarelainen et al. | |
| 9,522,806 | B2 | 12/2016 | Zapf et al. | |
| 9,546,076 | B2 | 1/2017 | Mikkonen et al. | |
| 9,561,937 | B2 | 2/2017 | Albu et al. | |
| 9,580,277 | B2 | 2/2017 | Metsanen et al. | |
| 9,840,398 | B2 | 12/2017 | Paasisalo et al. | |
| 2006/0042882 | A1 * | 3/2006 | Swaybill | B66B 11/0045 187/254 |

(Continued)

FOREIGN PATENT DOCUMENTS

| | | |
|---|---|---|
| CN | 104590971 A | 5/2015 |
| CN | 204751756 U | 11/2015 |

(Continued)

OTHER PUBLICATIONS

European Search Report; 19154306.5; dated Oct. 25, 2019; 8 Pages.

*Primary Examiner* — Diem M Tran

(74) *Attorney, Agent, or Firm* — Cantor Colburn LLP

(57) ABSTRACT

A deflector sheave mounting bracket for mounting a plurality of individual deflector sheaves of an elevator system includes a top plate, a bottom plate, and a plurality of support plates connected at a first end to the top plate and connected at a second, opposite end to the bottom plate. A plurality of openings for receiving the plurality of deflector sheaves is defined between pairs of adjacent support plates of the plurality of support plates. At least one opening of the plurality of openings is vertically offset and horizontally offset from another of the plurality of openings.

18 Claims, 9 Drawing Sheets

(56) References Cited

U.S. PATENT DOCUMENTS

| | | | | |
|---|---|---|---|---|
| 2006/0169542 | A1* | 8/2006 | Liebetrau | B66B 11/008 187/266 |
| 2006/0260879 | A1 | 11/2006 | Fischer et al. | |
| 2014/0027207 | A1* | 1/2014 | Yapar | B66B 11/008 187/254 |
| 2016/0257530 | A1 | 9/2016 | Forsstrom et al. | |
| 2016/0362279 | A1* | 12/2016 | St. Pierre | B66B 7/08 |
| 2017/0267491 | A1 | 9/2017 | Widmer | |

FOREIGN PATENT DOCUMENTS

| | | | |
|---|---|---|---|
| CN | 205076626 | U | 3/2016 |
| CN | 205204562 | U | 5/2016 |
| CN | 205527197 | U | 8/2016 |
| CN | 205602940 | U | 9/2016 |
| CN | 106185534 | A | 12/2016 |
| EP | 1535875 | A1 | 6/2005 |
| EP | 2567924 | A1 | 3/2013 |
| EP | 2567925 | A1 | 3/2013 |
| EP | 2859245 | A1 | 4/2015 |
| JP | 2013227133 | A | 11/2013 |
| WO | 2015076837 | A1 | 5/2015 |
| WO | 2017072260 | A1 | 5/2017 |
| WO | 2017162749 | A1 | 9/2017 |

* cited by examiner

DEFLECTOR SHEAVE BRACKET FOR OFFSET BEDPLATE

BACKGROUND

Embodiments of the disclosure relate to elevator systems, and more particularly, to a bedplate for mounting a machine in a machine room of an elevator system.

Vertical travel of an elevator car is typically powered by a drive assembly that may be supported within an upper portion of an elevator hoistway by a support member, such as a bedplate for example. The drive assembly generally includes a traction machine composed of a gearless motor and a traction sheave, both of which may be mounted on a surface of the bedplate. Rotational torque generated by the motor is used to drive the traction sheave. Depending on the direction of rotation of the motor the traction sheave causes tension members to lift or lower the elevator car and counterweight vertically through the hoistway.

In conventional elevator systems, the counterweight is commonly positioned directly behind the elevator car, centered with the elevator car, or to the side of the elevator car, centered on the car rails. However, older elevator system may have an asymmetrical layout, where the counterweight centered on the car rails is not generally centered relative to the car. To modernize these older elevator systems using existing bedplate structures, a time consuming and costly relocation of the counterweight is required.

BRIEF DESCRIPTION

According to one embodiment, a deflector sheave mounting bracket for mounting a plurality of individual deflector sheaves of an elevator system includes a top plate, a bottom plate, and a plurality of support plates connected at a first end to the top plate and connected at a second, opposite end to the bottom plate. A plurality of openings for receiving the plurality of deflector sheaves is defined between pairs of adjacent support plates of the plurality of support plates. At least one opening of the plurality of openings is vertically offset and horizontally offset from another of the plurality of openings.

In addition to one or more of the features described above, or as an alternative, in further embodiments the at least one opening is vertically offset and horizontally offset from an adjacent opening of the plurality of openings.

In addition to one or more of the features described above, or as an alternative, in further embodiments each of the plurality of openings is staggered.

In addition to one or more of the features described above, or as an alternative, in further embodiments each of the plurality of support plates includes at least one groove formed therein, and the at least one groove of the pairs of adjacent support plates cooperate to define the plurality of openings.

In addition to one or more of the features described above, or as an alternative, in further embodiments comprising the plurality of individual deflector sheaves, each of the plurality of individual deflector sheaves being mounted within one of the plurality of openings.

In addition to one or more of the features described above, or as an alternative, in further embodiments each of the plurality of individual deflector sheaves is rotatable about an axis and the plurality of axes of the plurality of individual deflector sheaves are substantially parallel.

In addition to one or more of the features described above, or as an alternative, in further embodiments the plurality of support plates include protrusions and the top plate and the bottom plate include openings for receiving the protrusions.

In addition to one or more of the features described above, or as an alternative, in further embodiments the protrusions are deformed relative to the openings to restrict movement of the plurality of support plates relative to the top plate and the bottom plate.

In addition to one or more of the features described above, or as an alternative, in further embodiments wherein the top plate, the bottom plate, and the plurality of support plates are permanently affixed.

In addition to one or more of the features described above, or as an alternative, in further embodiments the top plate, the bottom plate, and the plurality of support plates are welded together.

According to another embodiment, a support member for use in a machine room of an elevator system includes a base having a car end and a counterweight end. The counterweight end is arranged substantially parallel to a wall of the machine room and is arranged at an angle relative to the car end. A first deflector sheave having a plurality of grooves is mounted to the base in an orientation generally parallel to the car end. The first deflector sheave is configured to rotate about a first axis of rotation. A deflector sheave mounting bracket is connected to the base and defines a plurality of openings for receiving a plurality of individual second deflector sheaves. The plurality of openings is arranged in a staggered configuration substantially complementary to the angle of the counterweight end relative to the car end. A plurality of individual second deflector sheaves is mounted within the plurality of openings of the deflector sheave mounting bracket. Each of the plurality of individual second deflector sheaves is configured to rotate about a second axis of rotation parallel to the first axis of rotation.

In addition to one or more of the features described above, or as an alternative, in further embodiments each of plurality of openings is vertically offset and horizontally offset from an adjacent opening of the plurality of openings.

In addition to one or more of the features described above, or as an alternative, in further embodiments each of the plurality of individual second deflector sheaves is rotatable about an axis and the plurality of axes of the plurality of individual second deflector sheaves are substantially parallel.

In addition to one or more of the features described above, or as an alternative, in further embodiments the axis of each of the plurality of individual second deflector sheaves is arranged within a first plane or a second plane, vertically offset form the first plane.

In addition to one or more of the features described above, or as an alternative, in further embodiments the deflector sheave mounting bracket further comprises: a top plate, a bottom plate, and a plurality of support plates connected at a first end to the top plate and connected at a second, opposite end to the bottom plate; the plurality of openings for receiving the plurality of individual second deflector sheaves being defined between pairs of adjacent support plates of the plurality of support plates.

In addition to one or more of the features described above, or as an alternative, in further embodiments each of the plurality of support plates includes at least one groove formed therein, and the at least one groove formed in the pairs of adjacent support plates cooperate to define the plurality of openings.

In addition to one or more of the features described above, or as an alternative, in further embodiments the plurality of support plates include protrusions and the top plate and the bottom plate include openings for receiving the protrusions.

In addition to one or more of the features described above, or as an alternative, in further embodiments the protrusions are deformed relative to the openings to restrict movement of the plurality of support plates relative to the top plate and the bottom plate.

In addition to one or more of the features described above, or as an alternative, in further embodiments the top plate, the bottom plate, and the plurality of support plates are permanently affixed.

In addition to one or more of the features described above, or as an alternative, in further embodiments the top plate, the bottom plate, and the plurality of support plates are welded together.

BRIEF DESCRIPTION OF THE DRAWINGS

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

The detailed description explains embodiments of the disclosure, together with advantages and features, by way of example with reference to the drawings.

DETAILED DESCRIPTION

Figure 1:
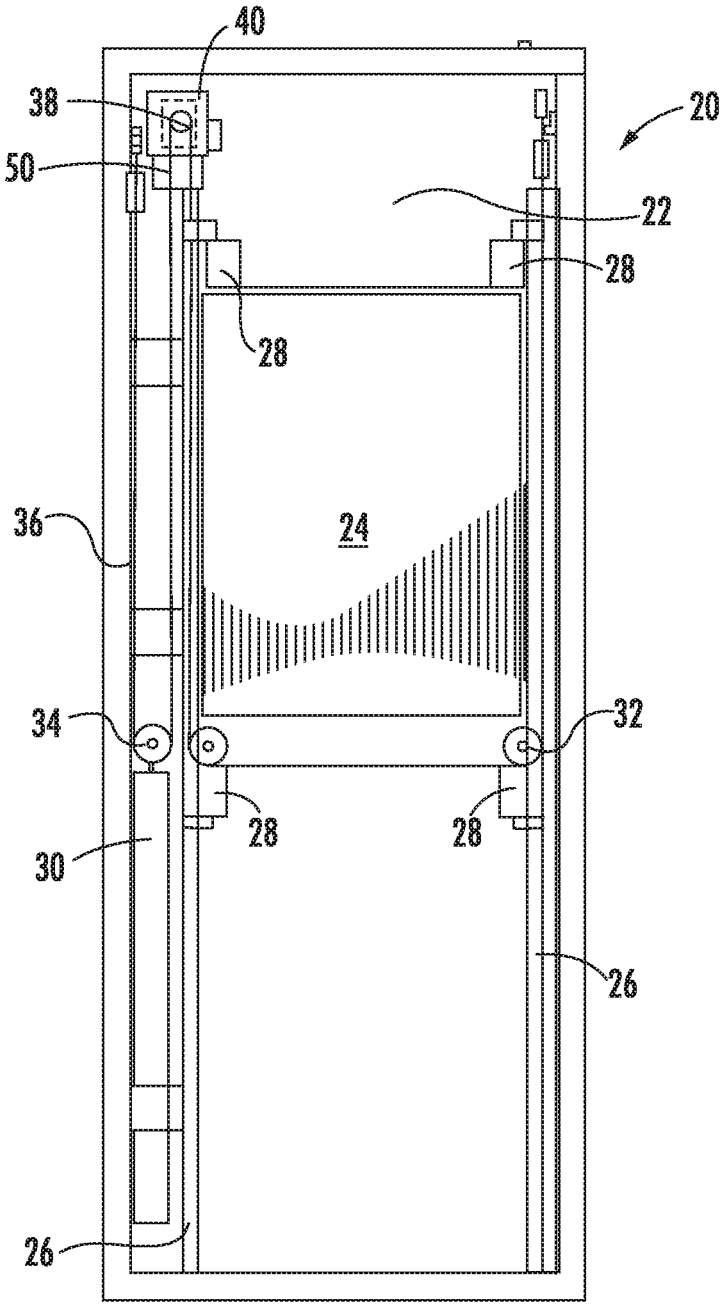
FIG. 1 is a cross-section of an example of an elevator system.

Referring now to FIG. 1, an exemplary elevator system 20 is illustrated. The elevator system 20 includes an elevator car 24 configured to move vertically upwardly and downwardly within a hoistway 22 between a plurality of floors along a plurality of car guide rails 26. Guide assemblies 28 mounted to the top and bottom of the elevator car 24 are configured to engage the car guide rails 26 to maintain proper alignment of the elevator car 24 as it moves within the hoistway 22.

The elevator system 20 also includes a counterweight 30 configured to move vertically upwardly and downwardly within the hoistway 22. The term counterweight 30 as used herein includes a counterweight assembly that may itself include various components as would be understood by a person skilled in the art. The counterweight 30 moves in a direction generally opposite the movement of the elevator car 24 as is known in conventional elevator systems. Movement of the counterweight 30 is guided by counterweight guide rails (not shown) mounted within the hoistway 22. In the illustrated, non-limiting embodiment, the elevator car 24 and counterweight 30 include sheave assemblies 32, 34, respectively, that cooperate with tension members 36 and a traction sheave 38 mounted to a drive machine 40 to raise and lower the elevator car 24. The drive machine 40 in the illustrated, non-limited embodiment, is suited and sized for use with flat tension members 36. The sheave assembly 32, shown in FIG. 1, is mounted to the bottom of the elevator car 24, such that the elevator system 20 has an underslung configuration. However, the sheave assemblies 32 may be mounted at another location on the elevator car 24, such as at the top thereof i.e. an overslung configuration for example, or elsewhere in the system 20 as recognized by a person skilled in the art.

The drive machine 40 of the exemplary elevator system 20 is positioned and supported at a mounting location atop a support member 50, such as a bedplate for example, in a portion of the hoistway 22 or a machine room. Although the elevator system 20 illustrated and described in herein has an underslung 2:1 roping configuration, elevator systems 20 having other roping configurations and hoistway layouts are within the scope of the disclosure.

Referring now to FIGS. 2-6, the support member 50 of the elevator system 20 is illustrated in more detail. The generally rectangular support member 50 includes a first car end 52 and a second counterweight end 58 positioned opposite the car end 52. A first connection member 64 couples the first side 54 of the car end 52 to the first side 60 of the counterweight end 58 and a second connection member 66 couples the second side 56 of the car end 52 to the second side 62 of the counterweight end 58. The counterweight end 58 is arranged at an angle θ relative to the car end 52 such that a distance between the first side 54 of the car end 52 and the first side 60 of the counterweight end 58 is less than the distance between the second side 56 of the car end 52 and the second side 62 of the counterweight end 58. The angle of the counterweight end 58 relative to the car end 52 is most clearly shown in the top view of the support member 50 illustrated in FIG. 6. In one embodiment, the angle θ of the counterweight end 58 relative to the car end 52 is in the range of greater than zero degrees to forty degrees. As a result, the first connection member 64 is generally shorter in length than the second connection member 66. Further, as shown, the counterweight end 58 of the support member 50 is configured to mount substantially parallel to a wall of the hoistway 22 or machine room, such as adjacent a corner of the hoistway 22 for example, such that the car end 52 of the support member 50 is disposed near a central portion of the hoistway 22 and/or machine room.

Figure 2:
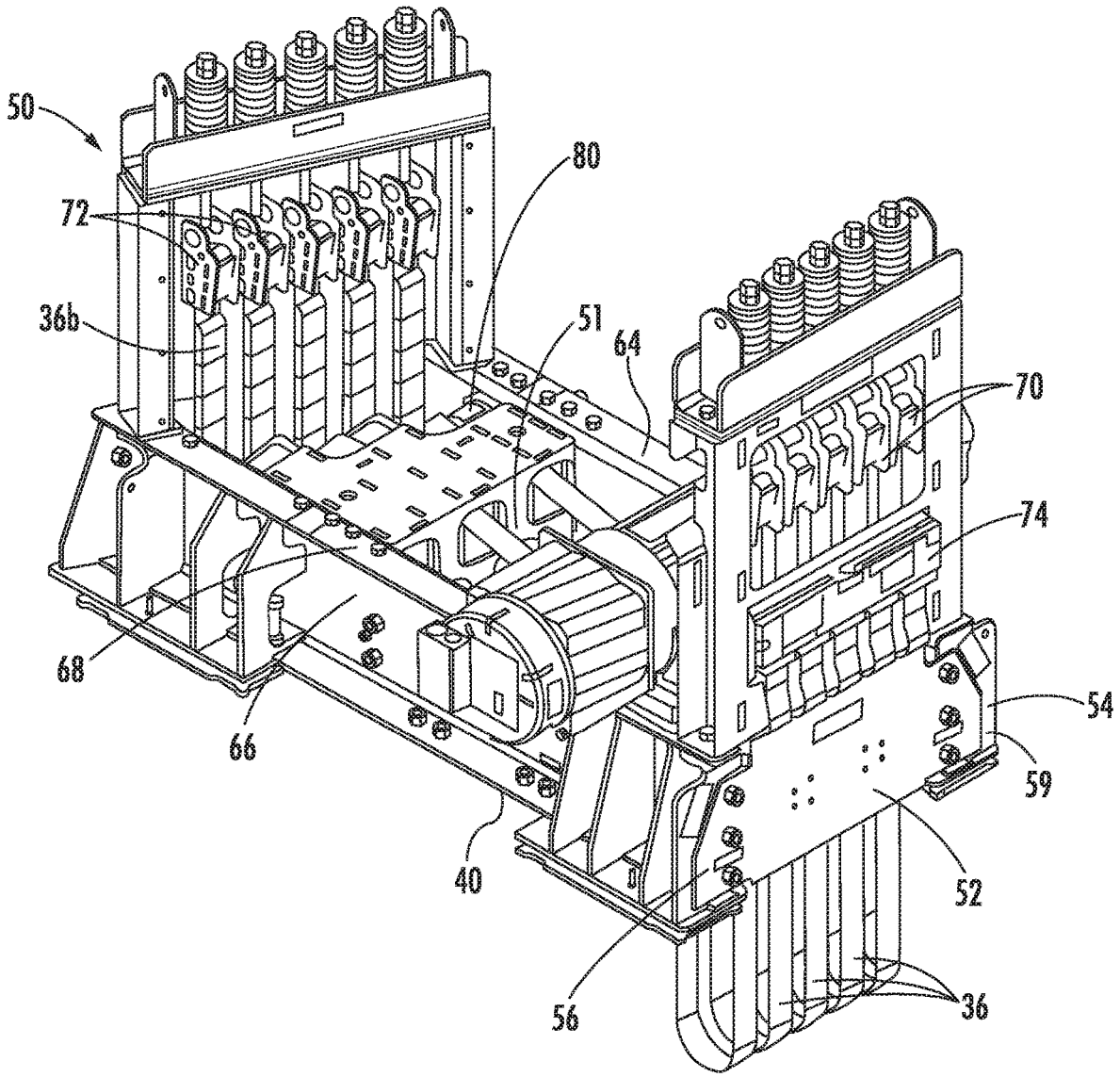
FIG. 2 is a perspective view of a support member of an elevator system according to an embodiment.
Figure 3:
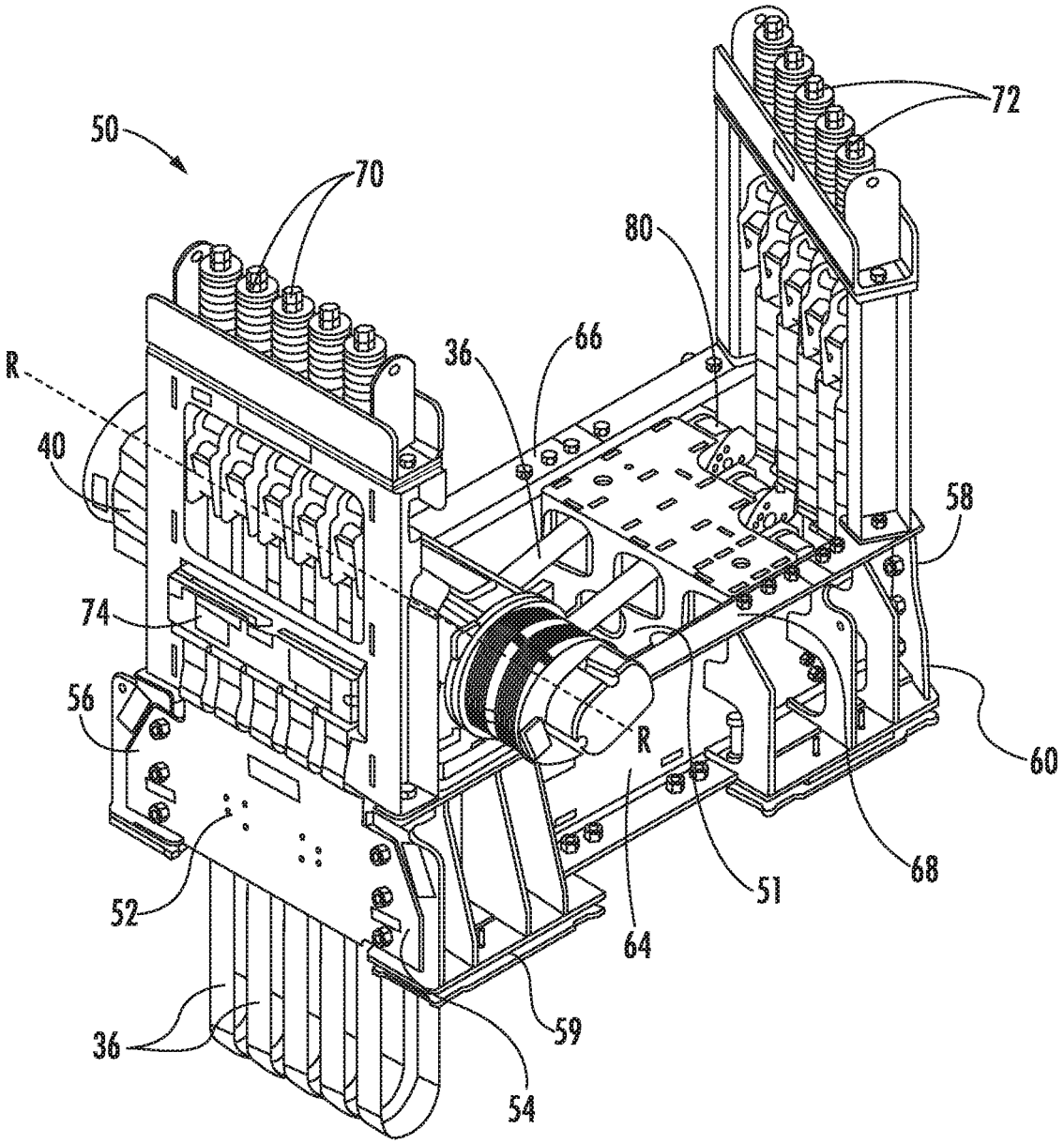
FIG. 3 is another perspective view of a support member of an elevator system according to an embodiment.
Figure 4:
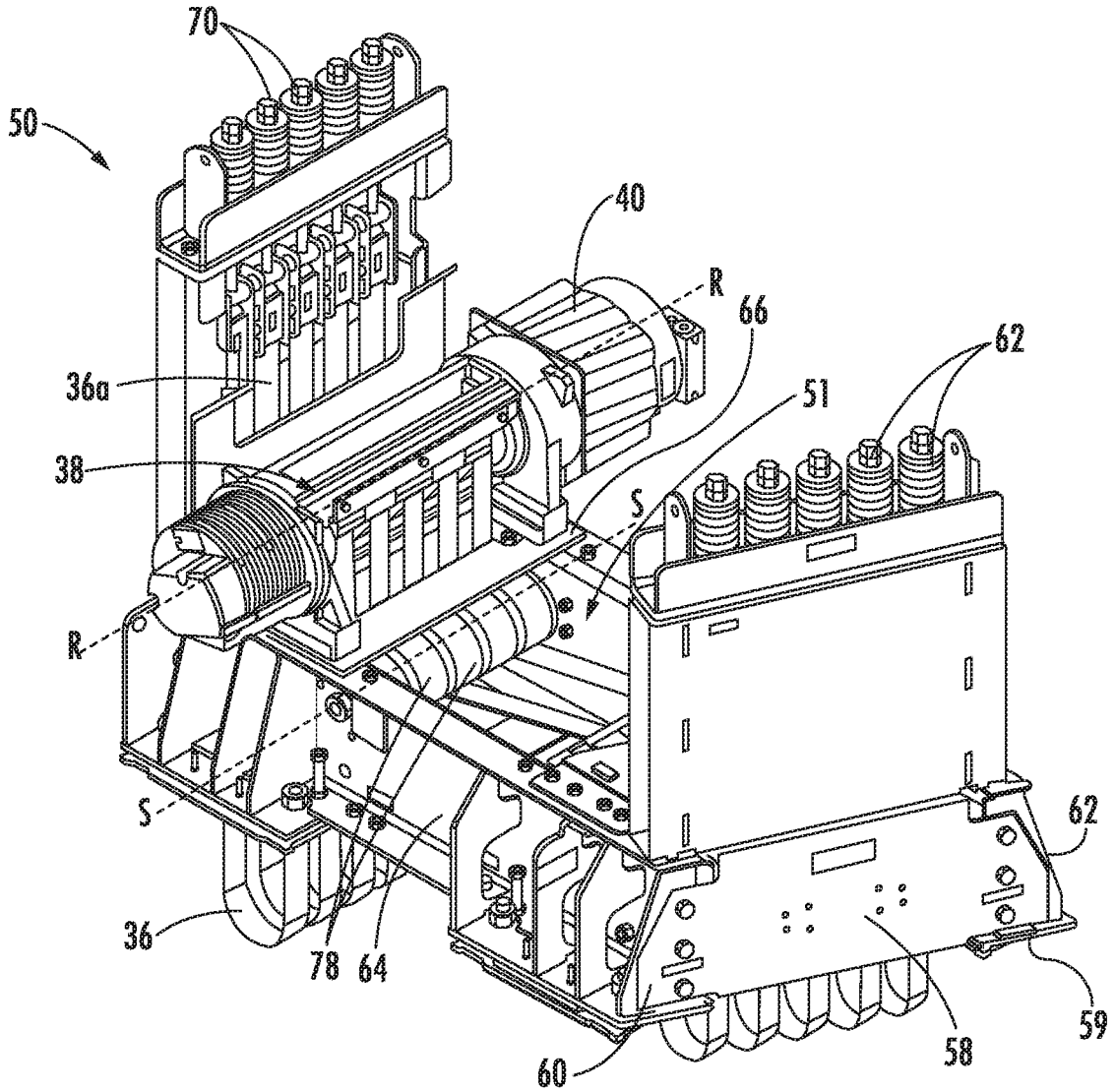
FIG. 4 is an alternate perspective view of a support member of an elevator system according to an embodiment.
Figure 5:
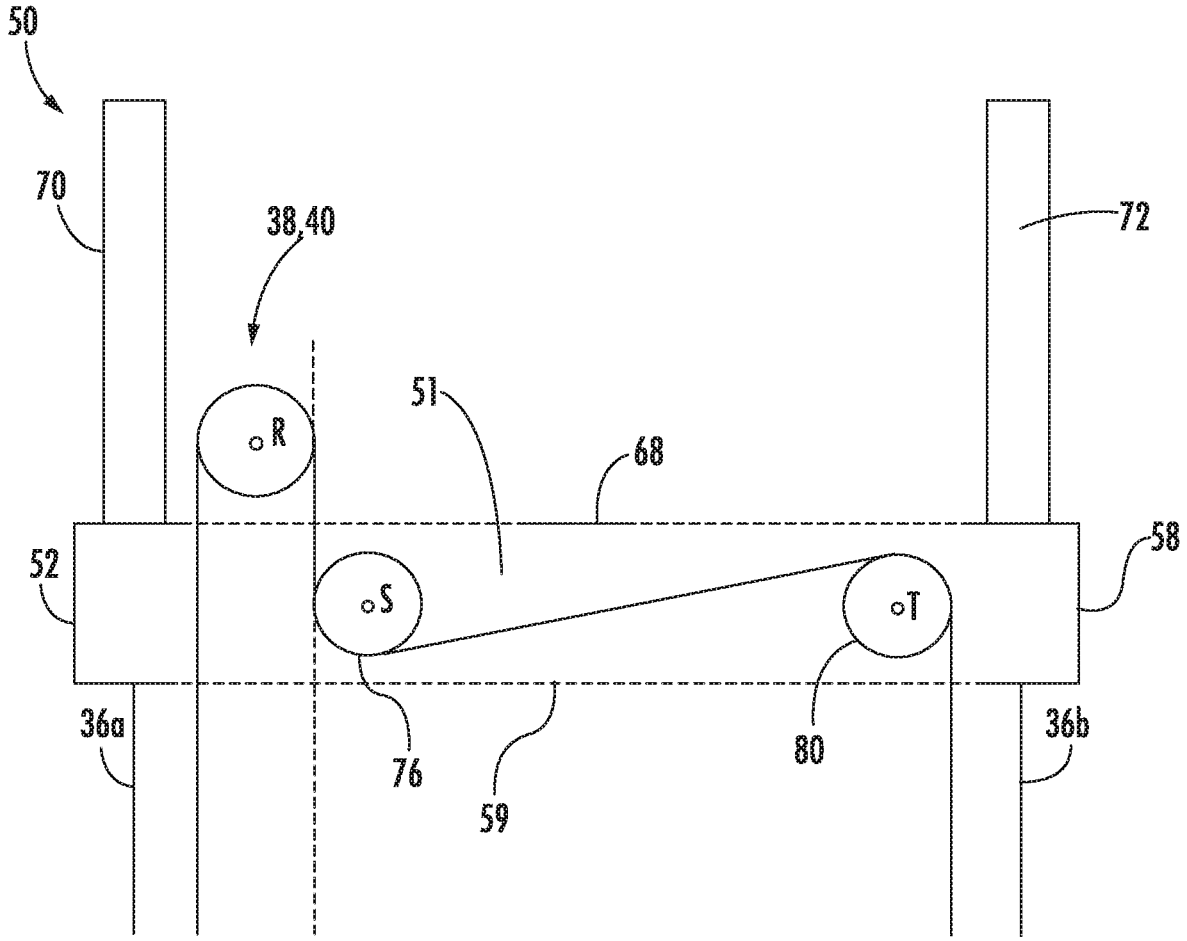
FIG. 5 is a cross-sectional view of a support member of an elevator system according to an embodiment.
Figure 6:
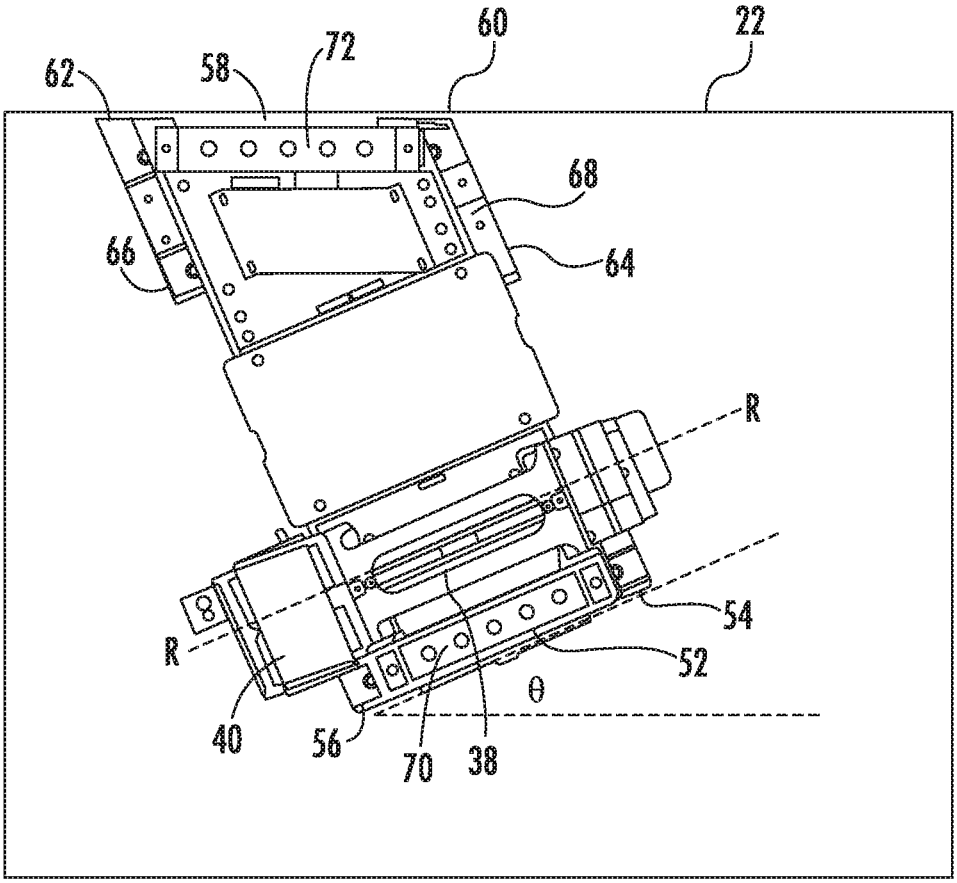
FIG. 6 is a top view of the support member of an elevator system according to an embodiment.

As is known, opposed ends of the tension members 36 are terminated in the elevator system 20 at dead end hitches 70 and 72. A plurality of dead end hitches 70, each being configured to connect to a car-side **36*a* (FIG. 4) of one of the plurality of tension members 36, is mounted at the upper surface 68 of the support member 50 adjacent the car end 52. The counterweight dead end hitches 72, each being configured to receive the counterweight-side 36*b* (FIG. 2) of one of the plurality of tension members 36, are similarly mounted about the upper surface 68 of the support member 50 at the counterweight end 58. In the illustrated non-limiting embodiment, the car and counterweight side dead end hitches 70, 72 are spaced vertically above the upper surface 68 of the support member 50. However, in other embodiments, the dead end hitches 70, 72 may be mounted to the upper surface or may extend below a bottom surface 59 of the support member 50 into the hoistway 22. In one embodiment, a tension member monitoring device 74 operably coupled to the car-side and/or the counterweight-side 36***a*, 36*b* of the tension members 36 may be connected to the support member 50, such as behind the car dead end hitches 70 (FIG. 2).

The drive machine 40, configured to rotate about an axis of rotation R, is mounted near the car end 52 of the support member 50 in an orientation substantially parallel thereto. In the illustrated, non-limiting embodiment, the drive machine 40 is mounted to the upper surface 68 of the support member 50; however the drive machine 40 may be arranged at another location about the support member 50, such as within the hollow interior 51 thereof for example. The traction sheave 38 (FIG. 1) mounted concentrically with the shaft of the drive machine 40 includes a plurality of grooves (not shown), each groove being configured to receive one of the plurality of tension members 36. In an embodiment, the traction sheave 38 and machine 40 are positioned such that grooves of the traction sheave 38 are generally aligned with the corresponding grooves (not shown) on the car sheave 32 (FIG. 1).

An deflector sheave 76 (best shown in FIG. 5) having a plurality of grooves 78 and an axis of rotation S is mounted to the support member 50, parallel to the drive machine 40. In the illustrated, non-limiting embodiment, the deflector sheave 76 is arranged in the hollow interior 51 of the support member 50, adjacent the machine 40, such that the tension members 36 extend generally vertically between traction sheave 38 and the deflector sheave 76. The deflector sheave 76 and the machine 40 may be arranged such that a portion of the circumference of the deflector sheave 76 is substantially coplanar with a portion of the circumference of the traction sheave 38. In addition, each of the plurality of grooves 78 of the deflector sheave 76 is generally horizontally aligned with one of the plurality of grooves of the traction sheave 38. In the illustrated embodiment, tension members 36 are configured to contact the traction sheave 38 around half of the circumference thereof.

A plurality of substantially identical individual deflector sheaves 80 are mounted to the support member 50 adjacent the counterweight side 58. Each individual deflector sheave 80 has a single groove 82 configured to receive one of the plurality of tension members 36 of the elevator system 20. The individual deflector sheaves 80 may be mounted within the hollow interior 51 of the support member 50.

Each of the individual deflector sheaves 80 is configured to rotate about a first axis of rotation T. The first axes of rotation T of the plurality of individual deflector sheaves 80 are substantially parallel to one another and are generally parallel to the axis of rotation R of the drive machine 40 and the axis of rotation S of the deflector sheave 76. Each of the plurality of individual deflector sheaves 80 is generally aligned with a corresponding groove 78 of the deflector sheave 76. The individual deflector sheaves 80 are arranged in a staggered configuration such that a distance between each deflector sheave 80 and an adjacent counterweight dead end hitch 72 associated therewith is substantially the same. As a result, the distance between the deflector sheave 76 and each of the individual deflector sheaves 80 gradually increases from the first side 60 of the counterweight end 58 to the second side 62 of the counterweight end 58.

After wrapping about a quarter of the circumference of the deflector sheave 76 and a quarter of the circumference of the individual deflector sheaves 80, the tension members 36 extend vertically to a deflector sheave 34 mounted to the counterweight 28, and then back to the support member 50 to connect to dead end hitches 72. The deflector sheaves 80 are generally aligned with grooves (not shown) on the counterweight sheave 34. In one embodiment, the individual deflector sheaves 80 and the counterweight sheave 34 on the counterweight are arranged such that a portion of the circumference of the each deflector sheave 80 is substantially coplanar with a portion of the circumference of the counterweight sheave 34. Although the support member 50 is described with a plurality of individual deflector sheaves 80, elevator systems where only some of the deflector sheaves 80 receive a tension member 36 are within the scope of the disclosure.

Figure 7:
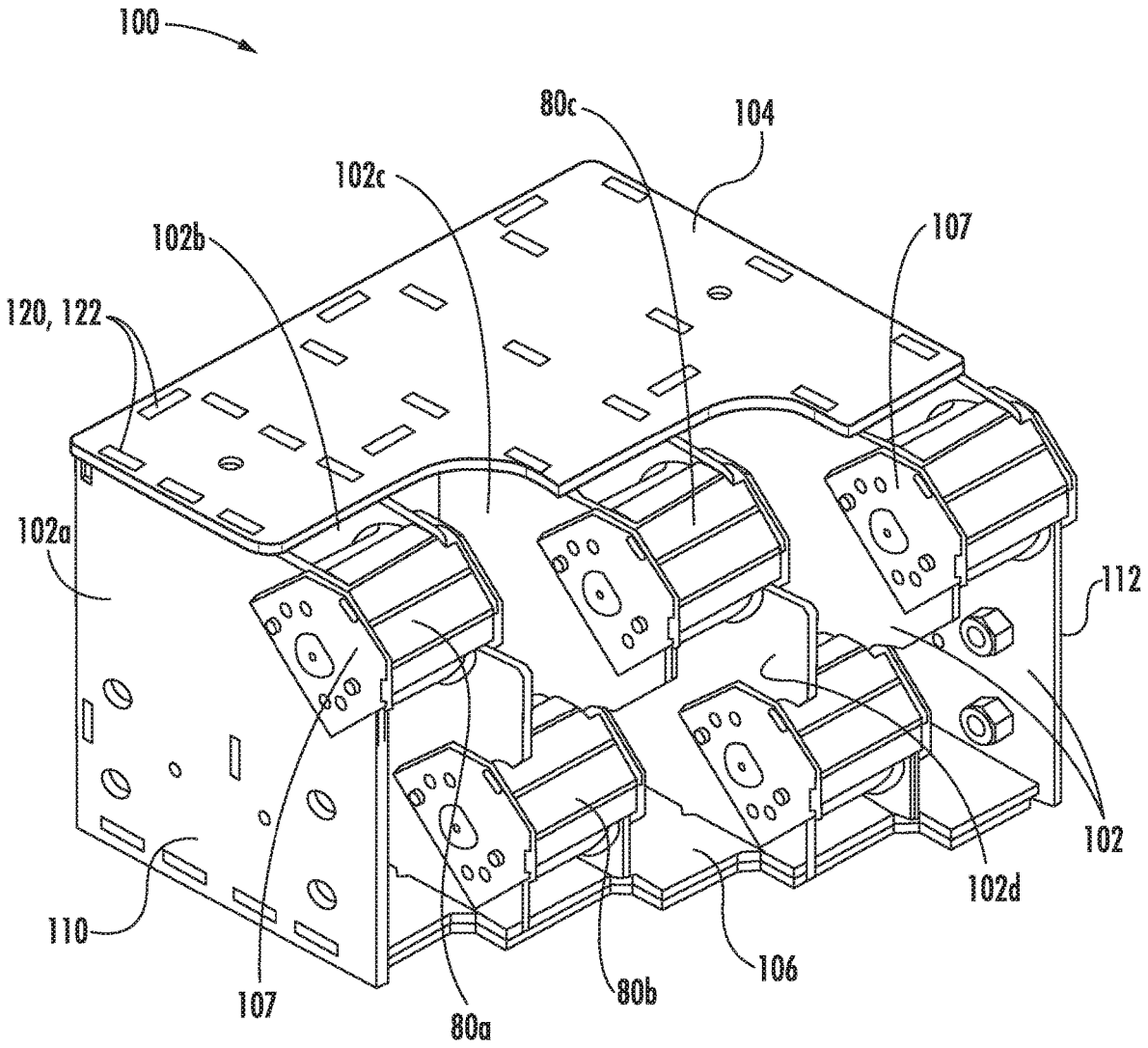
FIG. 7 is a perspective view of a deflector sheave bracket including the plurality of individual sheaves according to an embodiment.
Figure 8:
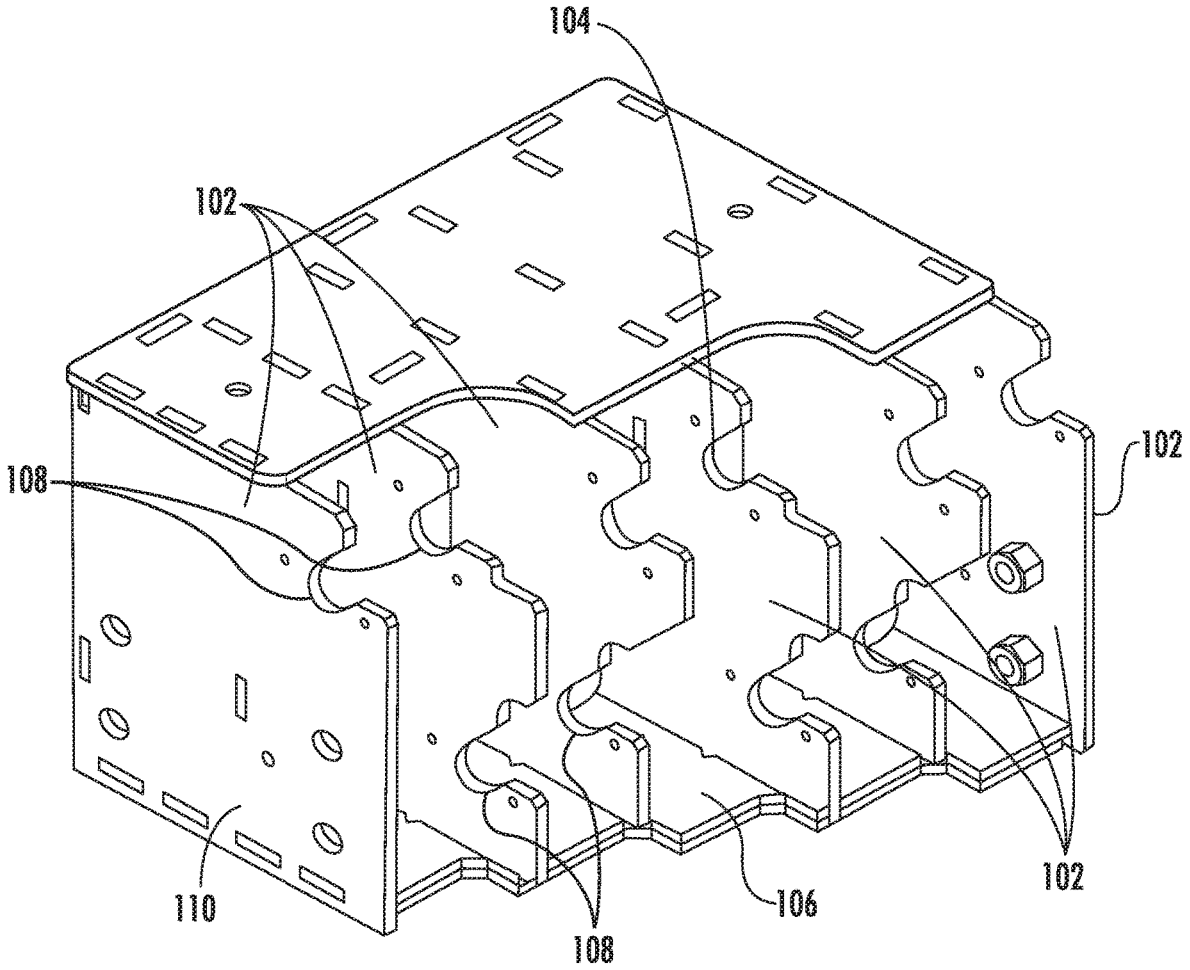
FIG. 8 is another perspective view of a deflector sheave bracket absent the plurality of individual sheaves according to an embodiment.
Figure 9B:
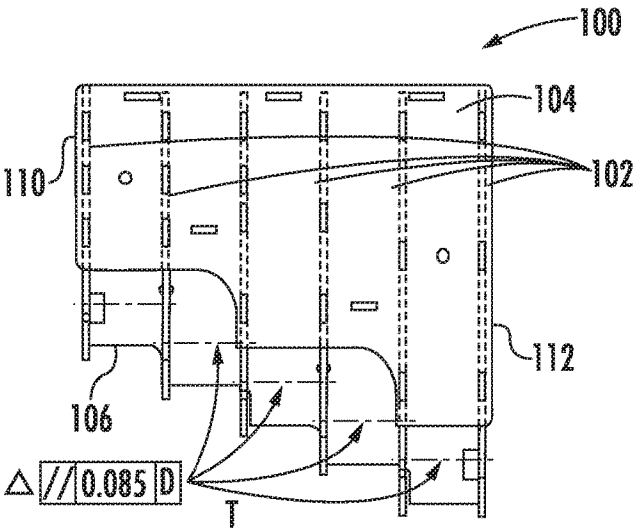
FIGS. 9A-9C are various isometric view of the deflector sheave bracket of FIG. 8 according to an embodiment.
Figure 9C:
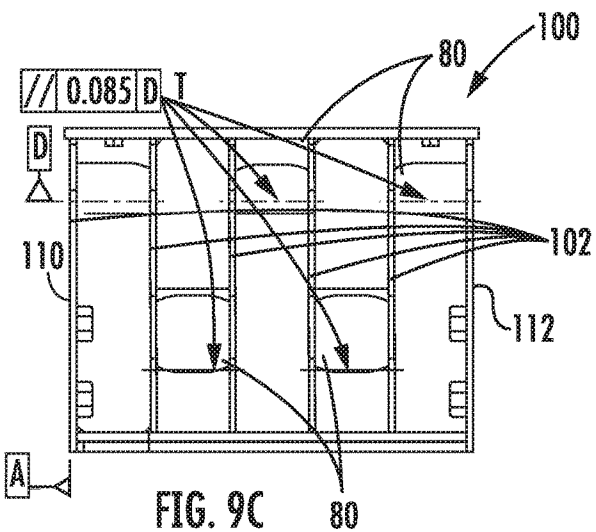
Figure 9A:
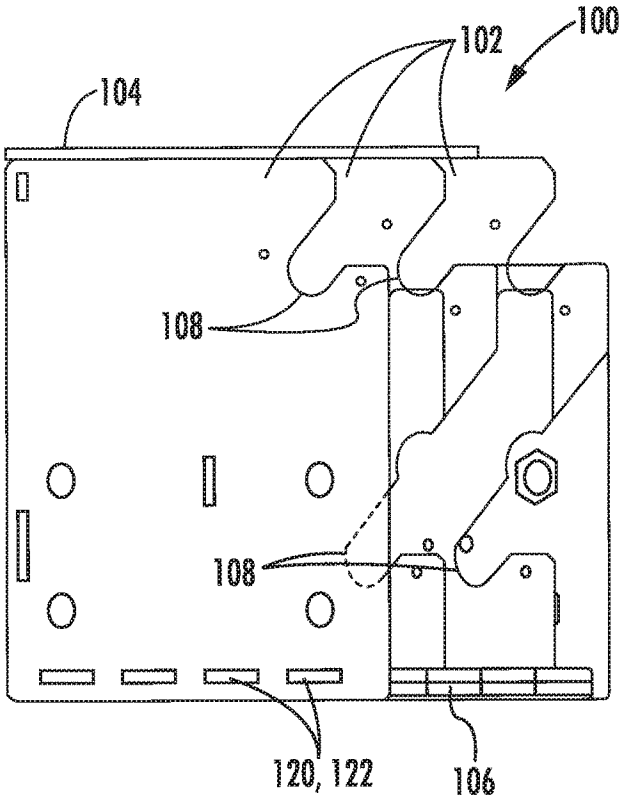

With reference now to FIGS. 7-9, a mounting configuration of the plurality of deflector sheaves 80 is illustrated in more detail. In the illustrated, non-limiting embodiment, the plurality of deflector sheaves 80 are mounted to the support member 50 via a deflector sheave mounting bracket 100, which may be positionable within the hollow interior 51 of the support member 50 for example. As shown the deflector sheave mounting bracket 100 includes a plurality of support plates 102, connected by a top plate 104 and a bottom plate 106. In the illustrated, non-limiting embodiment, the plurality of support plates 102 are oriented generally vertically and the top and bottom plates 104, 106 are oriented generally horizontally. However, embodiments where the support plates 102 and the top and bottom plate 104, 106 have another configuration are also contemplated herein.

Each support plate 102 has at least one elongated groove or cutout 108 formed therein for receiving a rotatable deflector sheave 80. As shown, the support plates 102 are generally arranged in pairs having identical and aligned grooves formed therein. Accordingly, a distance between the plates 102 within the pair corresponds to a width of a deflector sheave 80. To couple the deflector sheaves 80 to the mounting bracket 100, a keeper plate 107 may be located adjacent each side of the deflector sheave 80 in overlapping arrangement with a corresponding support plate 102.

Further, the deflector sheave mounting bracket 100 is configured to position the plurality of deflector sheaves 80 at multiple positions, such as within a first horizontal plane and a second horizontal plane offset vertically from the first horizontal plane. As shown in FIG. 7, adjacent pairs of support plates 102 may be configured to alternate or stagger the position of the deflector sheave 80 mounted thereto between the first horizontal plane and the second horizontal plane. For example, the first and second plates 102*a*, 102*b* cooperate to support a deflector sheave 80*a* within the first plane, generally adjacent the top plate 104, the second and third plates 102*b*, 102*c* cooperate to support a deflector sheave 80*b* within a second plane, parallel to the first plane, and generally adjacent the bottom plate 106. The third and fourth plates 102*c*, 102*d* cooperate to support a deflector sheave 80*c* within the first plane, generally adjacent the top plate 104. In addition, as shown in the FIGS., each sequential plate 102 extending from a first side 110 of the bracket to a second opposite side 112 of the deflector sheave mounting bracket 100 may gradually increase in length, measured from a back of the deflector sheave mounting bracket 100 to a front of the deflector sheave mounting bracket 100. As a result, each deflector sheave 80 mounted between adjacent pairs of plates 102 is not only vertically offset, but also horizontally offset from an adjacent deflector sheave 80. Maintaining both vertical and horizontal parallelism between each of the deflector sheaves 80 enhances proper tracking of the plurality of tension members 36 relative to the plurality of deflector sheaves 80.

To assemble the deflector sheave mounting bracket 100, the plurality of support plates 102 are connected to the top plate 104 and the bottom plate 106. It should be understood that the top plate 104 and the bottom plate 106 may be portions of the support member 50. In an embodiment, each of the plurality of support plates 102, the top plate 104, and the bottom plate 106 is formed with a plurality of openings 120 and/or corresponding tabs or protrusions 122. The protrusions 122, such as extending from the support plates 102 are receivable within the openings 120 formed in the top plate 104 and the bottom plate 106. Deforming the protrusions 122, i.e. such as by bending the protrusions 122 parallel to the adjacent surface of the top plate 104 or bottom plate 106, may further restrict separation of the support plates 102 from the top plate 104 and bottom plate 106. Once assembled, the support plates 102, the top plate 104, and the bottom plate 106 are then permanently affixed, such as via a welding operation for example.

After being permanently assembled, a coating, such as a powder coating for example, may be applied to the deflector sheave mounting bracket 100 to prevent rust and other degradation or wear of the deflector sheave mounting bracket 100. The plurality of grooves 108 may then be further machined to ensure proper alignment of the plurality of deflector sheaves 80 and the deflector sheaves 80 may then be installed into all or a portion of the grooves 108. In embodiments where one or more pairs of support plates 102 include cooperating grooves 108 that do not contain a deflector sheave 80, the empty grooves are typically located adjacent either the first side 110 or the second side 112 of the mounting bracket 100. As a result, each of the plurality of deflector sheaves 80 is mounted to the deflector sheave mounting bracket 100 at a pair of support plates 102 directly adjacent another pair of support plates 102 containing a deflector sheave 80.

By arranging the counterweight side 58 of the support member 50 substantially parallel to an adjacent hoistway wall (FIG. 5) the support member 50 may be easily mounted to the machine room floor. The support member 50 may be shipped partially or fully assembled, including additional components, such as, the deflector sheave 76, the individual deflector sheaves 80, the dead end hitches 70, 72, and the tension member monitoring system. Further assembly, such as of the coupled drive machine 40 and traction sheave 38 may be completed once the support member 50 is mounted in the machine room.

While the disclosure has been described in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that aspects of the disclosure may include only some of the described embodiments. Accordingly, the disclosure is not to be seen as limited by the foregoing description, but is only limited by the scope of the appended claims.

What is claimed is:

1. A deflector sheave mounting bracket for mounting a plurality of individual deflector sheaves of an elevator system, comprising:

a top plate;

a bottom plate; and a plurality of support plates connected at a first end to the top plate and connected at a second, opposite end to the bottom plate;

a plurality of openings for receiving the plurality of deflector sheaves defined between pairs of adjacent support plates of the plurality of support plates, wherein at least one of the plurality of openings is configured to receive a deflector sheave having a horizontally oriented axis of rotation, and at least one opening of the plurality of openings is vertically offset and horizontally offset from another of the plurality of openings.

2. The deflector sheave mounting bracket of claim 1, wherein the at least one opening is vertically offset and horizontally offset from an adjacent opening of the plurality of openings.

3. The deflector sheave mounting bracket of claim 1, wherein each of the plurality of openings is staggered.

4. The deflector sheave mounting bracket of claim 1, wherein each of the plurality of support plates includes at least one groove formed therein, and the at least one groove formed in adjacent support plates cooperate to define the plurality of openings.

5. The deflector sheave mounting bracket of claim 1, further comprising the plurality of individual deflector sheaves, each of the plurality of individual deflector sheaves being mounted within one of the plurality of openings.

6. The deflector sheave mounting bracket of claim 5, wherein each of the plurality of individual deflector sheaves is rotatable about a respective axis of a plurality of axes and each of the plurality of axes of the plurality of individual deflector sheaves are substantially parallel to one another.

7. The deflector sheave mounting bracket of claim 1, wherein the plurality of support plates include protrusions and the top plate and the bottom plate include openings for receiving the protrusions.

8. The deflector sheave mounting bracket of claim 1, wherein the protrusions are deformed relative to the openings to restrict movement of the plurality of support plates relative to the top plate and the bottom plate.

9. The deflector sheave mounting bracket of claim 1, wherein the top plate, the bottom plate, and the plurality of support plates are permanently affixed.

10. The deflector sheave mounting bracket of claim 9, wherein the top plate, the bottom plate, and the plurality of support plates are welded together.

11. A support member for use in a machine room of an elevator system, comprising:

a base including a car end and a counterweight end, the counterweight end being arranged substantially parallel to a wall of the machine room, the counterweight end being arranged at an angle relative to the car end;

a first deflector sheave having a plurality of grooves mounted to the base in an orientation generally parallel to the car end, the first deflector sheave being configured to rotate about a first axis of rotation;

a plurality of individual second deflector sheaves, each of the plurality of individual second deflector sheaves being configured to rotate about a second axis of rotation of a plurality of second axes of rotation oriented parallel to the first axis of rotation; and a deflector sheave mounting bracket connected to the base, the deflector sheave mounting bracket defining a plurality of openings for receiving the plurality of individual second deflector sheaves, the plurality of openings being arranged in a staggered configuration substantially complementary to the angle of the counterweight end relative to the car end, wherein each of plurality of openings is vertically offset and horizontally offset from an adjacent opening of the plurality of openings.

12. The support member of claim 11, wherein the second axis of each of the plurality of individual second deflector sheaves is arranged within a first plane or a second plane, vertically offset form the first plane.

13. The support member of claim 11, wherein the deflector sheave mounting bracket further comprises:

a top plate;

a bottom plate; and a plurality of support plates connected at a first end to the top plate and connected at a second, opposite end to the bottom plate;

the plurality of openings for receiving the plurality of individual second deflector sheaves being defined between pairs of adjacent support plates of the plurality of support plates.

14. The support member of claim 13, wherein each of the plurality of support plates includes at least one groove formed therein, and the at least one groove formed in the pairs of adjacent support plates cooperate to define the plurality of openings.

15. The support member of claim 13, wherein the plurality of support plates include protrusions and the top plate and the bottom plate include openings for receiving the protrusions.

16. The support member of claim 13, wherein the protrusions are deformed relative to the openings to restrict movement of the plurality of support plates relative to the top plate and the bottom plate.

17. The support member of claim 13, wherein the top plate, the bottom plate, and the plurality of support plates are permanently affixed.

18. The support member of claim 17, wherein the top plate, the bottom plate, and the plurality of support plates are welded together.

* * * * *